US009551181B2

(12) United States Patent
Withrow

(10) Patent No.: US 9,551,181 B2
(45) Date of Patent: Jan. 24, 2017

(54) JOINT SEALS FOR FLEXIBLE WALL PANELS

(71) Applicant: Ryan Withrow, Platteville, WI (US)

(72) Inventor: Ryan Withrow, Platteville, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 14/722,458

(22) Filed: May 27, 2015

(65) Prior Publication Data

US 2016/0348422 A1 Dec. 1, 2016

(51) Int. Cl.
*F25D 23/06* (2006.01)
*E06B 7/16* (2006.01)
*E06B 3/46* (2006.01)

(52) U.S. Cl.
CPC ..... *E06B 7/16* (2013.01); *E06B 3/4636* (2013.01)

(58) Field of Classification Search
CPC ..... E06B 7/16; E04B 2/74; E04B 2/72; E04B 2/7403; E04B 1/767; E04B 1/7616; F25D 23/02; F25D 23/023
USPC ..... 24/432
See application file for complete search history.

(56) References Cited

U.S. PATENT DOCUMENTS 2,420,706 A * 5/1947 Haven ..... E04H 1/1238 135/115
3,962,729 A * 6/1976 Cook ..... A44B 19/34 2/234
4,426,816 A * 1/1984 Dean ..... A44B 18/0069 160/368.1
4,437,505 A * 3/1984 Rodgers ..... A47H 21/00 160/126
4,628,545 A * 12/1986 Metzler ..... A41F 1/00 112/475.09
4,691,478 A 9/1987 Lorg
4,801,180 A 1/1989 Styles
5,143,137 A 9/1992 West
RE37,139 E * 4/2001 Krickl ..... B32B 5/06 181/290

(Continued)

FOREIGN PATENT DOCUMENTS

| | | |
|---|---|---|
| DE | 19528243 | 2/1996 |
| JP | 3882007 | 2/2007 |
| NL | 1005170 | 8/1998 |

OTHER PUBLICATIONS

International Searching Authority, "Search Report", issued in connection with PCT patent application No. PCT/US2016/033268, mailed on Jul. 26, 2016, 5 pages.

(Continued)

*Primary Examiner* — Katherine Mitchell
*Assistant Examiner* — Abe Massad
(74) *Attorney, Agent, or Firm* — Hanley, Flight & Zimmerman, LLC

(57) ABSTRACT

Example room dividers are disclosed herein. An example room divider includes a first panel and a second panel. A first seal between the first panel and the second panel is to provide a first line of contact with at least one of the first panel or the second panel. A second seal between the first panel and the second panel is to provide a second line of contact with at least one of the first panel or the second panel. A touch-and-hold fastener connects the first panel and the second panel. The touch-and-hold fastener is positioned between the first line of contact and the second line of contact.

31 Claims, 3 Drawing Sheets

(56) References Cited

U.S. PATENT DOCUMENTS

| | | | | |
|---|---|---|---|---|
| 6,675,390 | B1 * | 1/2004 | Chang | A41D 3/00 2/96 |
| 2009/0140097 | A1 | 6/2009 | Collier et al. | |
| 2010/0269427 | A1 | 10/2010 | Digmann et al. | |
| 2012/0018103 | A1 | 1/2012 | Ashelin et al. | |
| 2013/0255159 | A1 | 10/2013 | Hoffmann | |
| 2014/0166214 | A1 * | 6/2014 | Hoffmann | E05D 1/06 160/38 |

OTHER PUBLICATIONS

Nternational Searching Authority, "Written Opinion", issued in connection with PCT patent application No. PCT/US2016/033268, mailed on Jul. 26, 2016, 4 pages.

* cited by examiner

JOINT SEALS FOR FLEXIBLE WALL PANELS

FIELD OF THE DISCLOSURE

This patent generally pertains to flexible room dividers and, more specifically, to joint seals for flexible wall panels.

BACKGROUND

Some room dividers are comprised of a series of semi-flexible curtains that are suspended from an overhead structure and are interconnected along their vertical edges by hook-and-loop fasteners. Such room divider assemblies provide a relatively quick, easy, and affordable way for separating interior spaces having different environmental requirements or for isolating spaces from dust, paint overspray, odors, and/or other airborne contaminants.

Insulation may be added to the curtains of the room dividers to reduce heat migration within a building and help maintain a desired air temperature and/or humidity within designated areas. Such areas are often used for storing refrigerated or frozen foods and/or other perishable goods.

Some room dividers are made of curtains having special qualities for certain purposes. For example, some curtains have acoustic insulation for noise absorption, impenetrable strength for security, and/or flame resistance for limiting the spread of smoke and fire.

DETAILED DESCRIPTION

Figure 1:
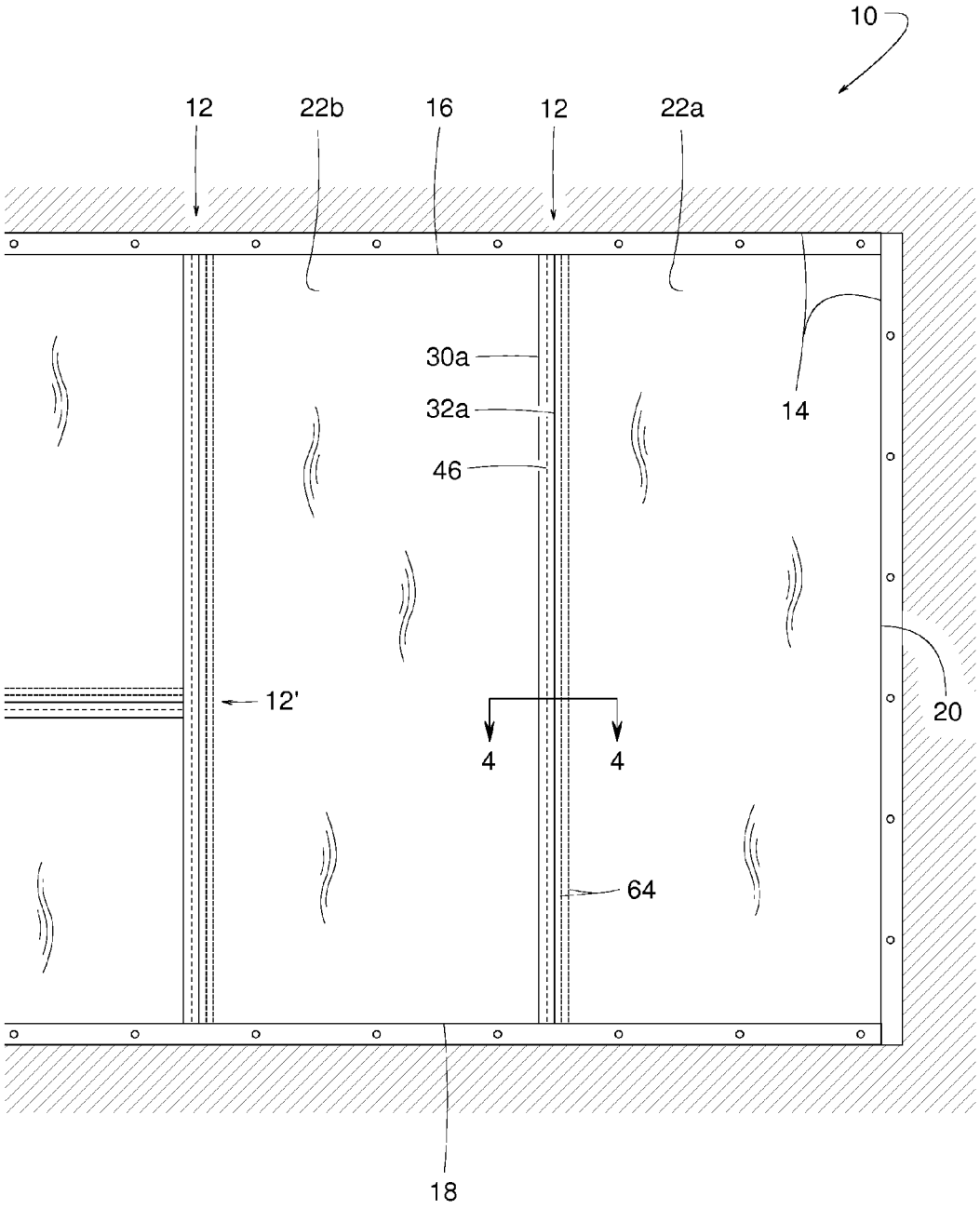
FIG. 1 is a front view of an example room divider constructed in accordance with the teachings disclosed herein.

Example room dividers disclosed herein include a plurality of flexible panels interconnected along vertical edges by, for example, fasteners (e.g., touch-and-hold fasteners, VELCRO®). Vertically elongate seals on either side of each fastener shelter the fastener from heat. The adjoining interlocking faces of the fasteners create an interface that is air permeable. In some examples, the seals disclosed herein may prevent air and/or airborne contaminants from passing through the interface provided by the interlocking faces of the fasteners. In some examples, the seals are hollow and have an internal loop that urges the seal toward an adjacent panel.

FIGS. 1-4 show an example room divider 10 (divider assembly) having (e.g., two or more) panels that are interconnected along a first joint 12 (e.g., a vertical joint) and/or a second joint 12' (e.g., a horizontal joint) to provide a divider assembly for use, for example, within a building 14.

The divider assembly's upper edge 16, lower edge 18 and/or lateral edges 20 can be fastened to a ceiling, wall, floor and/or structural features of building 14 by any suitable means (e.g., screws, overhead hangers, mounting track, angle iron, channel, bar, cable, clips, hooks, clamps and various combinations thereof). The room divider 10 is useable for various purposes, examples of which include, but are not limited to, separating two areas within a building; blocking off a hallway leading to a certain area; isolating spaces from dust, paint overspray, odors and/or other contaminants; and/or creating a blast freezer or cold storage room next to a warmer area within a building. In some examples, the room divider 10 is thermally insulated and/or heat resistant.

Figure 2:
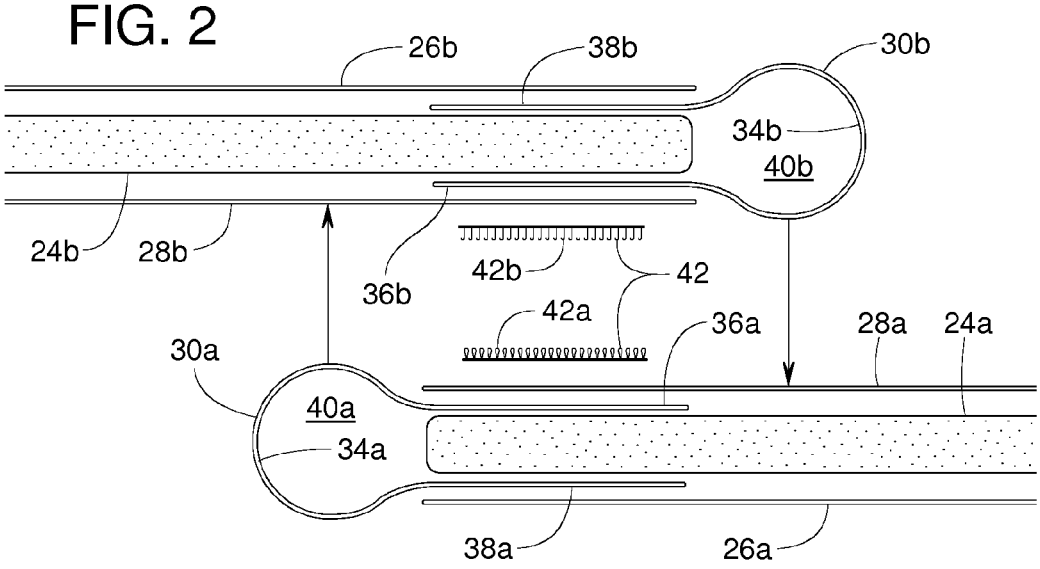
FIG. 2 is a cross-sectional exploded view corresponding to FIG. 4.
Figure 3:
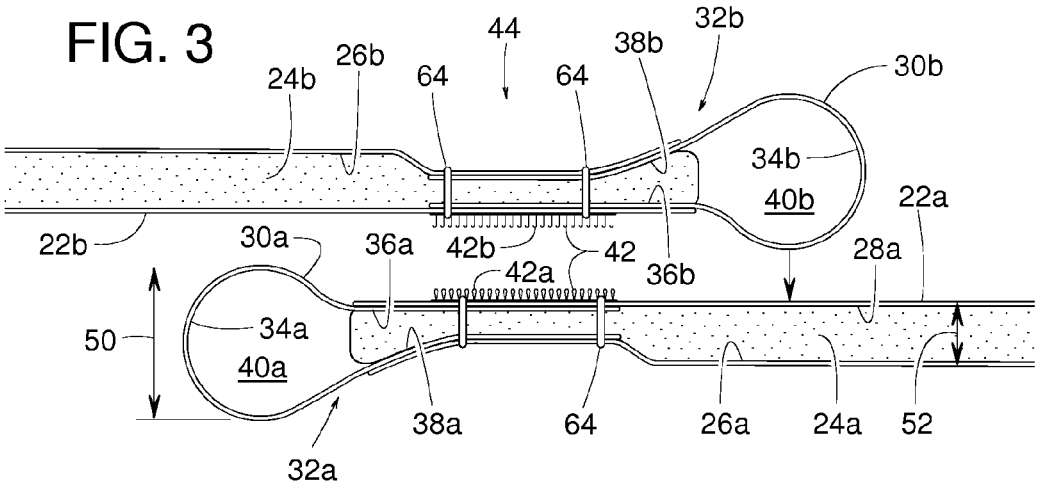
FIG. 3 is a cross-sectional assembly view corresponding to FIG. 4.
Figure 4:
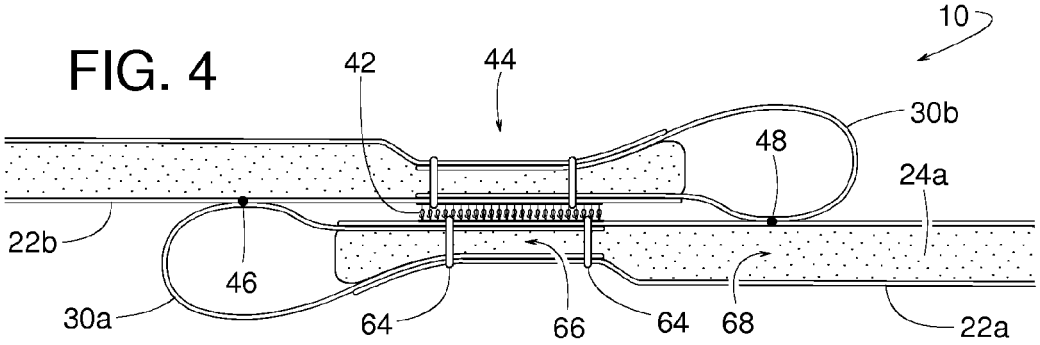
FIG. 4 is a cross-sectional view taken along line 4-4 of FIG. 1.

Referring to FIGS. 2-4, the example of room divider 10 of the illustrated example includes a first panel 22*a* connected or coupled to a second panel 22*b*. In this example, the first panel 22*a* includes a first core 24*a* sandwiched between a first outer sheet 26*a* and a first connecting sheet 28*a*. The first core 24*a* of the illustrated example is lightweight (due to its low density), pliable, compressible and resilient, which makes first panel 22*a* easy to handle, sew, install and/or ship. Example materials of the first core 24*a* include, but are not limited to, open-cell foam, closed-cell foam, polyester batting and carbon fiber batting. Such materials can provide thermal insulation and/or heat resistance. Example materials of the sheets 26*a* and 28*a* include, but are not limited to, plastic sheeting, heat resistant sheeting, coated fabric, uncoated fabric, single-layer sheeting, multilayer sheeting, and/or various combinations thereof. In some examples, the sheets 26*a* and 28*a* are made of vinyl coated polyester, which is pliable and lightweight (due to its relative thinness). Such material qualities further help in making first panel 22*a* easy to handle, sew, install and/or ship. Example couplings, fasteners and/or means for connecting the first outer sheet 26*a* and the first connecting sheet 28*a* include, but are not limited to, sewing, thermal welding, adhesive bonding and/or any other suitable fastener(s).

In the example shown in FIGS. 2-4, a first seal 30*a* extends along a first edge 32*a* of the first panel 22*a*. In this example, the first seal 30*a* is in the shape of a channel including a first web 34*a* extending between a first connecting flange 36*a* and a first outer flange 38*a*. The first connecting flange 36*a* connects or couples to the first connecting sheet 28*a*, and the first outer flange 38*a* connects or couples to the first outer sheet 26*a*. The first web 34*a* is spaced apart from the panel's first edge 32*a* to create a first air chamber 40*a* between the first web 34*a* and the first edge 32*a*. The first seal 30*a* of the illustrated example has a channel shape and contains and/or defines the first air chamber 40*a*. The first seal 30*a* and/or the first air chamber 40*a* provides a conforming resilient seal against the adjoining second panel 22*b* and helps protect a less heat resistant touch-and-hold fastener 42 that connects or couples the panels 22*a* and 22*b*.

In some examples, to provide the first seal 30*a* with a desired level of stiffness and durability, the seal 30*a* is made of the same material of the sheets 26*a* and 28*a* and has a thickness that is greater than a thickness of the sheet 26*a* and/or the sheet 28*a*. In some examples, the first seal 30*a* and the sheets 26*a* and 28*a* have the same material thickness. In some examples, the first outer flange 38*a* is an integral extension of the first outer sheet 26*a*, where the first seal 30*a* and the first outer sheet 26*a* is a unitary piece or structure. In some examples, the first connecting flange 36*a* is an integral extension of the first connecting sheet 28*a*, where the first seal 30*a* and the first connecting sheet 28*a* is a unitary piece or structure. In some examples, the first seal 30*a* is an integral extension of the sheets 26*a* and 28*a*. For greater heat resistance, example materials of the first seal 30*a* include, but are not limited to, silicone impregnated fiberglass, chlorosulfonated polyethylene (CSPE) synthetic rubber (CSM), and/or HYPALON sheeting (HYPALON is a registered trademark of DuPont).

In some examples, the panels 22*a* and 22*b* are substantially similar or identical, particularly in the area where the panels 22*a* and 22*b* connect or couple to each other. More specifically, the second panel 22*b* includes a second core 24*b*, a second outer sheet 26*b*, a second connecting sheet 28*b* and a second edge 32*b*. The second core 24*b*, the second outer sheet 26*b*, the second connecting sheet 28*b* and/or the second edge 32*b* respectively correspond and/or are similar in structure (e.g., are identical) to the respective first core 24*a*, the first outer sheet 26*a*, the first connecting sheet 28*a* and the first edge 32*a*. For example, a second seal 30*b* of the second panel 22*b* is substantially similar or identical in structure to the first seal 30*a*. The second seal 30*b* includes a second web 34*b*, a second outer flange 38*b*, a second connecting flange 36*b* and a second air chamber 40*b*. The second web 34*b*, the second outer flange 38*b*, the second connecting flange 36*b* and the second air chamber 40*b* respectively correspond and/or are substantially similar in structure (e.g., identical) to the respective first web 34*a*, the first outer flange 38*a*, the first connecting flange 36*a* and the first air chamber 40*a*.

To connect or couple the second panel 22*b* to the first panel 22*a*, a first strip 42*a* of touch-and-hold fastener 42 is sewn, bonded and/or otherwise attached (attached directly or indirectly) to the first connecting sheet 28*a* proximate the first edge 32*a* of the first panel 22*a*. Likewise, a second strip 42*b* of touch-and-hold fastener 42 is sewn, bonded and/or otherwise attached (attached directly or indirectly) to the second connecting sheet 28*b* proximate the second edge 32*b* of the second panel 22*b*. When brought together, the strips 42*a* and 42*b* matingly interlock or couple in a manner known to those of ordinary skill in the art of touch-and-hold fasteners. The term, "touch-and-hold fastener" described herein refers to an assembly of two strips of material having a broad distribution of elements that releasably interlock when facing surfaces of the strips engage. In some examples, the strips accommodate extensive misalignment in a direction parallel to the facing surfaces of the strips. An example touch-and-hold fastener is a VELCRO® hook-and-loop fastener (VELCRO® is a registered trademark of Velcro Industries). In some examples, touch-and-hold fastener 42 is installed or positioned at or adjacent an overlapping area 44 of the panels 22*a* and 22*b*. The overlapping area 44 increases (e.g., maximizes) joint strength and seal integrity between the panels 22*a* and 22*b*. In some examples, the width of the overlapping area 44 is approximately equal to the width of the touch-and-hold fastener 42.

In some instances, some known touch-and-hold fasteners have a low tolerance to heat and may not provide an air-tight seal between the interlocking faces. For example, cold or warm air may flow sideways between the strips 42*a* and 42*b* of touch-and-hold fastener 42 causing frost along the joint and/or heat loss across the interlocking faces. Airflow through strips of touch-and-hold fastener 42 might also convey airborne contaminants between two areas otherwise separated by the room divider. For cost advantages, some examples of touch-and-hold fastener 42 provide less heat resistant than the seals 30*a* and 30*b*, the sheets 26*a*, 26*b*, 28*a* and 28*b*, and/or cores 24*a* and 24*b*.

To overcome the air permeability and/or low heat resistance of the touch-and-hold fastener 42, the seals 30*a* and 30*b* shelter, trap or isolate the touch-and-hold fastener 42 between a first sealing line of contact 46 (established by the first seal 30*a* engaging the second panel 22*b*) and a second sealing line of contact 48 (established by the second seal 30*b* engaging the first panel 22*a*), as shown in FIG. 4. To ensure the continuity of contact lines 46 and 48, each of the seals 30*a* and 30*b* expanded channel-shape and internal air chamber provides a collapsible chamber or bubble (e.g., a bubble-like effect) that helps each seal 30*a* and 30*b* to conform to the contour of the respective seal-engaged panel 22*b* and 22*a* while providing sufficient seal-to-panel sealing pressure to inhibit frost and/or heat loss along the interlocking faces of the touch and hold fastener 42. In some examples, adequate sealing is achieved by providing the seals 30*a* and 30*b* with a seal thickness 50 that is greater than an average thickness 52 of the panels 22*a* and 22*b*.

Figure 5:
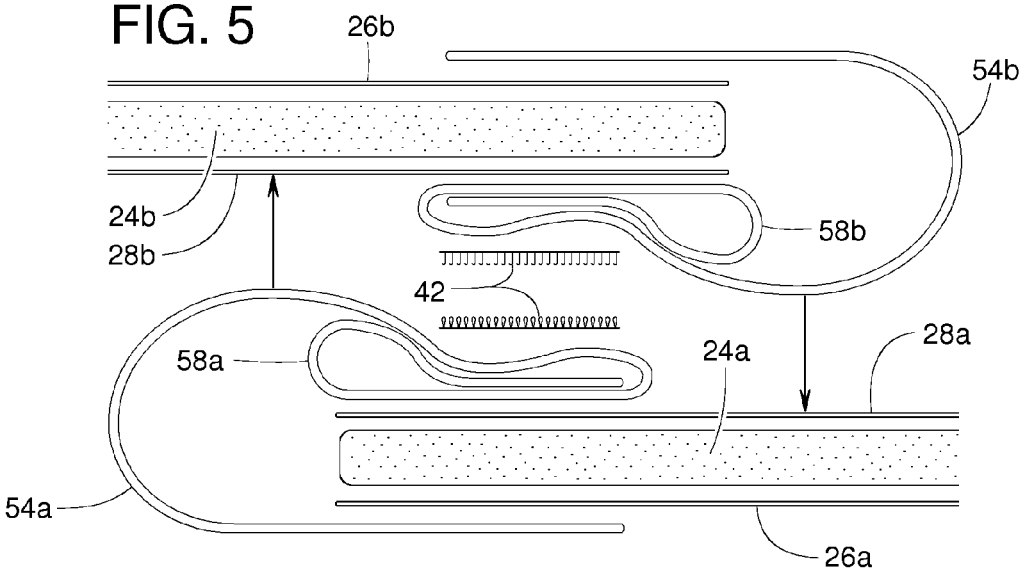
FIG. 5 is a cross-sectional exploded view similar to FIG. 2 but showing another example room divider constructed in accordance with the teachings disclosed herein.
Figure 6:
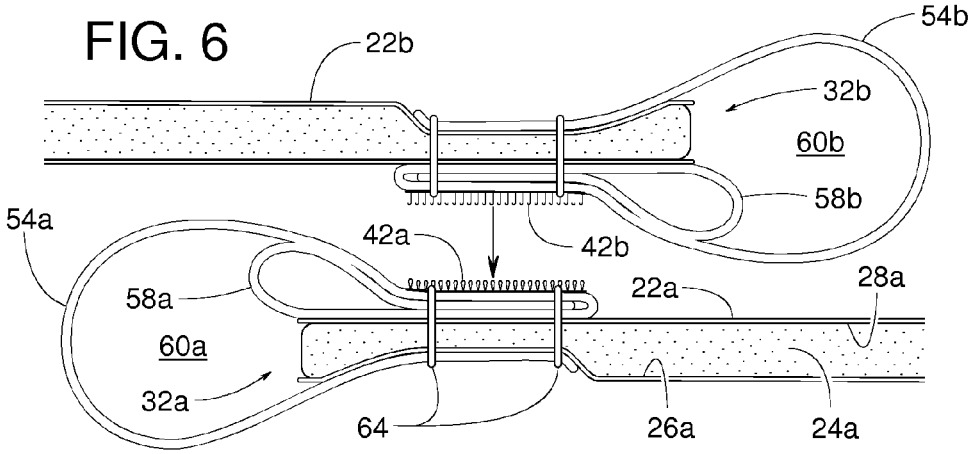
FIG. 6 is a cross-sectional assembly view similar to FIG. 3 but showing the example room divider of FIG. 5.
Figure 7:
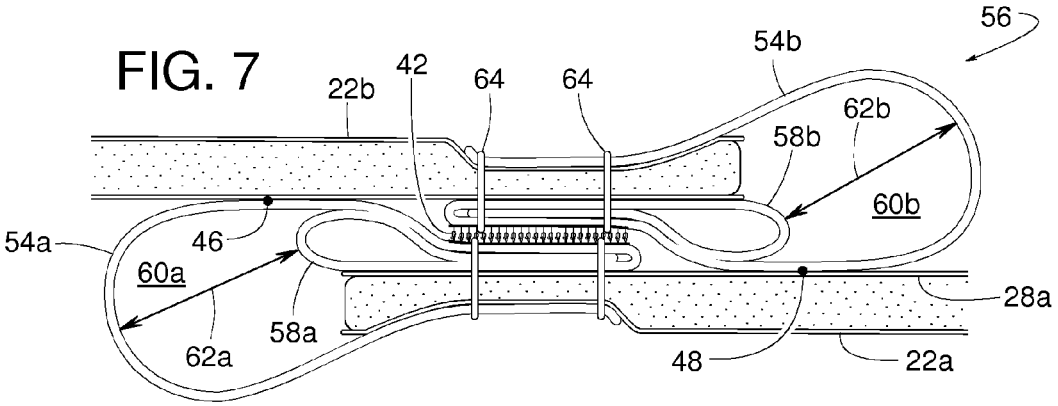
FIG. 7 is a cross-sectional view similar to FIG. 4 but showing the example room divider of FIG. 5.

To provide greater seal-to-panel sealing pressure, example seals 54*a* and 54*b* of an example room divider 56 shown in FIGS. 5-7 include internal loops 58*a* and 58*b* that urge an exterior portion of the seals 54*a* and 54*b* toward the respective panels 22*b* and 22*a* to which the seals 54*a* and 54*b* press against and/or engage. More specifically, the first seal 54*a* contains the first loop 58*a* inside a first air chamber 60*a* of the first seal 54*a*. The first loop 58*a* and the first seal 54*a* define an air gap 62*a* between the first loop 58*a* and the first seal 54*a*. The air gap 62*a* provides a collapsible chamber or bubble (e.g., a bubble-like effect). In some examples, the first loop 58*a* is made of the same material as the first seal 54*a*. In some examples, the first loop 58*a* is made of the same material as the first connecting sheet 28*a*. In the illustrated example, the first loop 58*a* is an integral extension of the first seal 54*a*, where the first loop 58*a* and the first seal 54*a* are a unitary piece of material or structure. In some examples, the second seal 54*b* is substantially equivalent to the first seal 54*a*. For example, the second seal 54*b* includes a second loop 58*b* corresponding and/or substantially similar to the first seal 54*a* and the first loop 58*a*, respectively.

In some examples, a heat resistant thread provides a threaded seam 64 that attaches the strips 42*a* and 42*b* to their respective panels 22*a* and 22*b*, attaches the seals 30*a*, 30*b*, 54*a* and 54*b* to their respective panels 22*a* and 22*b*; and/or pinches the panel's edges (e.g., edges 32*a* and 32*b*). Pinching the edges 32*a* and 32*b* causes the cores 24*a* and 24*b* to be more dense along the edges and less likely to burn or become damaged when exposed to (e.g., high) heat. More specifically, in the example of FIGS. 2-4, the first core 24*a* is denser in a first area 66 proximate the first seal 30*a* than at a second area 68 that is spaced apart from the first area 66.

For further clarification, it should be noted that the term, "pliable" refers to a material that can be readily folded over onto itself and later unfolded and/or restored to its original shape without appreciable damage to the material. The term, "heat resistant" is a measure of a material's temperature at which it begins to melt, burn and/or become damaged due to heat. The term, "unitary" refers to a single piece that is seamless.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A room divider, comprising:

a first panel including a first outer sheet, a first connecting sheet, and a first core positioned between the first outer sheet and the first connecting sheet;

a second panel including a second outer sheet, a second connecting sheet, and a second core positioned between the second outer sheet and the second connecting sheet;

a first seal attached to a first edge of the first panel, the first seal extending from the first edge to provide a first line of contact with at least one of the first panel or the second panel, the first seal directly contacting the first outer sheet and the first connecting sheet;

a second seal attached to a second edge of the second panel, the second seal extending from the second edge to provide a second line of contact with at least one of the first panel or the second panel, the second seal directly contacting the second outer sheet and the second connecting sheet; and a touch-and-hold fastener to connect the first panel and the second panel, the touch-and-hold fastener being positioned between the first line of contact of the first seal and the second line of contact of the second seal, the first seal and the second seal to shelter the touch-and-hold fastener between the first line of contact and the second line of contact to restrict air flow through the touch-and-hold fastener.

2. The room divider of claim 1, wherein the first line of contact, the second line of contact and the touch-and-hold fastener are vertically elongate.

3. The room divider of claim 1, wherein the first line of contact is between the first seal and the second panel, and the second line of contact is between the second seal and the first panel.

4. The room divider of claim 1, wherein the first panel and the second panel are pliable and resilient.

5. The room divider of claim 1, wherein the first seal and the second seal are more heat resistant than the touch-and-hold fastener.

6. The room divider of claim 1, wherein the first panel comprises a core that is more dense in a first area proximate the first seal than at a second area that is spaced apart from the first area.

7. The room divider of claim 1, wherein the first seal has a channel shape defining a first air chamber between the first seal and the first panel.

8. The room divider of claim 7, further comprising a first loop inside the first air chamber of the first seal, the first loop and the first seal defining an air gap between the first loop and the first seal.

9. The room divider of claim 8, wherein the first loop comprises an integral extension of the first seal such that the first loop and the first seal are a unitary piece of material.

10. A room divider, comprising:

a first panel including a first outer sheet, a first connecting sheet, and a first core positioned between the first outer sheet and the first connecting sheet;

second panel including a second outer sheet, a second connecting sheet, and a second core positioned between the second outer sheet and the second connecting sheet;

the second panel to overlap the first panel to provide an overlapping area between the first panel and the second panel;

a first seal attached to a first edge of the first panel, the first seal to extend from the first edge of the first panel to engage the second panel along a first line of contact, the first seal configured to directly contact the first outer sheet and the first connecting sheet;

a second seal attached to a second edge of the second panel, the second seal to extend from the second panel to engage the first panel along a second line of contact, the second seal configured to directly contact the second outer sheet and the second connecting sheet; and a touch-and-hold fastener positioned between the first panel and the second panel at the overlapping area, the touch-and-hold fastener being positioned between the first line of contact and the second line of contact, and the first seal and the second seal being more heat resistant than the touch-and-hold fastener.

11. The room divider of claim 10, wherein the first panel and the second panel are pliable and resilient.

12. The room divider of claim 10, wherein the first line of contact, the second line of contact and the touch-and-hold fastener are vertically elongate.

13. The room divider of claim 10, wherein the first panel comprises a core that is more dense in a first area proximate the touch-and-hold fastener than at a second area that is proximate the second line of contact.

14. The room divider of claim 10, wherein the first seal comprises a channel shape to define a first air chamber between the first seal and the first panel.

15. The room divider of claim 14, further comprising a first loop inside the first air chamber of the first seal, the first loop and the first seal defining an air gap between the first loop and the first seal.

16. The room divider of claim 15, wherein the first loop is an integral extension of the first seal such that the first loop and the first seal comprise a unitary piece of material.

17. A room divider, comprising:

a first panel including a first outer sheet, a first connecting sheet and a first core positioned between the first outer sheet and the first connecting sheet, the first panel having a first edge that is vertically elongate;

a first seal extending along the first edge of the first panel, the first seal having a channel shape, the first seal including a first web, a first connecting flange and a first outer flange, the first web to extend between the first connecting flange and the first outer flange, the first connecting flange being attached to the first connecting sheet, the first outer flange being attached to the first outer sheet, the first web being spaced apart from the first edge of the first seal to define a first air chamber defined by the first web, the first connecting flange, the first outer flange and the first edge of the first panel, the first seal configured to directly contact the first outer sheet and the first connecting sheet;

a second panel including a second outer sheet, a second connecting sheet and a second core positioned between the second outer sheet and the second connecting sheet, the second panel having a second edge that is vertically elongate;

a second seal attached to the second edge of the second panel, the second seal having channel shape, the second seal including a second web, a second connecting flange and a second outer flange, the second web to extend between the second connecting flange and the second outer flange, the second connecting flange being attached to the second connecting sheet, the second outer flange being attached to the second outer sheet, the second web being spaced apart from the second edge of the second seal to define a second air chamber defined by the second web, the second connecting flange, the second outer flange and the second edge of the second panel, the second seal configured to directly contact the second outer sheet and the second connecting sheet; and a touch-and-hold fastener including a first strip and a second strip, the first strip attachable to the first connecting sheet proximate the first edge of the first panel, the second strip attachable to the second connecting sheet proximate the second edge of the second panel, the first strip being removably attachable to the second strip, the first outer sheet and the second outer sheet facing in substantially opposite directions, the first seal to engage the second connecting sheet along a first line of contact, the second seal to engage the first connecting sheet along a second line of contact, the touch-and-hold fastener being interposed between the first line of contact and the second line of contact.

18. The room divider of claim 17, wherein the first connecting flange of the first seal is spaced apart from the second connecting sheet of the second panel, and the second connecting flange of the second seal is spaced apart from the first connecting sheet of the first panel.

19. The room divider of claim 17, wherein the touch-and-hold fastener is interposed between the first connecting flange of the first seal and the second connecting flange of the second seal.

20. The room divider of claim 17, wherein the first seal and the second seal are more heat resistant than the touch-and-hold fastener.

21. The room divider of claim 17, wherein the first seal, the second seal, the first outer sheet, the second outer sheet, the first connecting sheet, the second connecting sheet, the first core and the second core each are more heat resistant than the touch-and-hold fastener.

22. The room divider of claim 17, further comprising a threaded seam joining the first strip, the first connecting sheet, the first connecting flange, the first core, the first outer flange and the first outer sheet.

23. The room divider of claim 17, wherein the first core is more dense in a first area between the first connecting flange and the first outer flange than at a second area spaced farther away from the first seal.

24. The room divider of claim 17, wherein the first seal has a seal material thickness, the first outer sheet has a sheet material thickness, the seal material thickness is greater than the sheet material thickness, the first seal and the first outer sheet being substantially equivalent in material composition.

25. The room divider of claim 17, further comprising a first loop inside the first air chamber of the first seal, the first loop and the first seal defining an air gap between the first loop and the first seal.

26. The room divider of claim 25, wherein the first loop is an integral extension of the first seal such that the first loop and the first seal comprise a unitary piece of material.

27. The room divider of claim 17, wherein the first connecting sheet and the first outer sheet comprise a pliable sheet material.

28. The room divider of claim 17, wherein the first core comprises a pliable and resiliently compressible material.

29. The room divider of claim 17, wherein the first connecting flange is directly attached to the first connecting sheet and the first outer flange is directly attached to the first outer sheet.

30. The room divider of claim 17, wherein the first connecting flange is positioned between the core and the first connecting sheet.

31. The room divider of claim 30, wherein the first outer flange is positioned between the core and the first outer sheet.

* * * * *